US005322918A

United States Patent [19]

Kirby

[11] Patent Number: 5,322,918

[45] Date of Patent: Jun. 21, 1994

[54] DISPOSABLE PAPER BATH TOWEL WITH INTEGRAL APERTURES AND TIE

[76] Inventor: Shirley J. Kirby, R.R. 1, Box 148C, Flora, Ind. 46929

[21] Appl. No.: 900,159

[22] Filed: Jun. 17, 1992

[51] Int. Cl.[5] ..... B32B 23/02; B32B 7/14; B32B 27/10; A41D 13/04

[52] U.S. Cl. ..... 428/192; 428/136; 428/137; 428/198; 428/201; 428/224; 428/241; 428/288; 428/290; 428/507; 225/23; 225/67; 2/48; 2/50; 2/51; 2/52

[58] Field of Search ..... 428/137, 192, 136, 137, 428/198, 201, 224, 246, 288, 290, 507; 2/48-52; 225/23, 67

[56] References Cited

U.S. PATENT DOCUMENTS

| | | | |
|---|---|---|---|
| 4,003,509 | 1/1977 | Camarero | 225/23 |
| 4,075,382 | 2/1978 | Chapman et al. | 428/192 |
| 5,085,914 | 2/1992 | Perdelwitz | 428/137 |

*Primary Examiner*—Patrick J. Ryan

*Assistant Examiner*—Richard C. Weisberger

*Attorney, Agent, or Firm*—Woodard, Emhardt, Naughton, Moriarty & McNett

[57] ABSTRACT

A disposable body towel includes a tie and apertures for retaining the towel around a bather. The disposable towel comprises a flexible substantially planar non-woven laminated sheet having top, bottom and side edges and includes a plurality of fibrous water absorbent cellulose plies. The sheet includes an outer ply and an inner ply, wherein the outer ply is water absorbent. The sheet possesses sufficient structural strength when wet to resist degradation in the presence of liquids and is sized to substantially cover a body. The inner and outer plies are bonded together by biodegradable resin at the side edges, thereby reinforcing said side edges for providing additional resistance to tearing. The sheet includes an adjustable tie attached to said top edge and apertures along said top edge for securing the towel about the body as said towel is positioned to substantially cover the body.

12 Claims, 4 Drawing Sheets

DISPOSABLE PAPER BATH TOWEL WITH INTEGRAL APERTURES AND TIE

BACKGROUND OF THE INVENTION

This invention relates to the field of bath towels and more particularly to a disposable bath towel having a tie and a plurality of apertures for securing the towel around a person.

Woven cloth is commonly used for bath towels and beach towels. Frequently there are occasions where the use of a cloth towel which must be washed and dried is either impractical or inconvenient. Also the laundering of cloth towels can be costly for beauty parlors, hospitals, nursing homes, hotels, etc. A disposable bath towel would save water, detergent and labor. However, even with all of the advantages of disposable towels and disadvantages of cloth towels, the prior art disposable towels have been unable to supplant cloth towels for the bath and beach. The following patents are provided for background information.

U.S. Pat. No. 4,075,382 to Chapman, et al relates to a disposable non-woven surgical towel and method of making it. The surgical towel includes an outer tissue layer adhered to a medium density thermoplastic, long fibered, non-woven material and includes a center ply constituting a low density melt blown long fibered non-woven material. The use of the thermoplastic material significantly reduces the biodegradability of the surgical towel. The surgical towel also lacks means for securing the towel about a person.

U.S. Pat. No. 4,003,509 to Camarero discloses a disposable bath towel and dispensing device. The patent discloses a series of absorbent tear-off elongated sheets of paper imprinted to have opposite ends with simulated borders and having felted absorbent fibers extending from the imprinted surface along the length of the respective sheets with multi-color zones resembling quality textile cloth toweling. A series of sheets is shown rolled and mounted for cranking forwardly beneath a spring biased roller to a position beneath a tear blade such that the disposable simulated bath towel sheets maybe cranked to a tear-off position one at a time and torn away for use. The Camarero towel lacks a reinforcing tear resistant border, a folded stack dispenser, treatment for enhanced wet strength, quilting and lacks means for securing the towel around a bather.

The present invention is designed provide a convenient alternative to cloth towels and thereby avoid the labor and expense of washing cloth towels.

SUMMARY OF THE INVENTION

Briefly describing one aspect of the present invention, a disposable bath towel comprises a flexible substantially planar non-woven laminated sheet having top edges, bottom edges, side edges and a border. The sheet includes a plurality of fibrous water absorbent cellulose plies. In one embodiment, the sheet includes an outer ply and an inner ply, wherein the outer plies are formed from soft water absorbent material. The inner plies need not be as soft as the outer plies and may add additional strength or additional water absorbency. The inner and outer plies are bonded together by resin along the border, thereby reinforcing the side edges for providing additional resistance to tearing. The sheet has sufficient structural strength when wet to resist tearing in the presence of liquids and being sized to substantially cover a bather's body.

The sheet further includes an adjustable tie attached to the top edge and apertures for securing the towel about a person as the towel is positioned to substantially cover the body.

One object of the present invention is to provide a disposable bath towel which may be used to dry off a bather and which has sufficient strength to resist tearing when wet. A further object is to provide a disposable towel which may be used for the beach or at swimming pools.

Another object is to provide a disposable towel for use in hospitals or nursing homes thereby allowing the used linens to be conveniently disposed of. A further object of the present invention is to provide an economical home guest towel for use when additional demands are placed on home linen supplies.

Another object is to provide a disposable towel which may be secured around the body of a person. A further object is to provide a disposable towel suitable for use in beauty parlors.

Other objects, and certain benefits, of the present invention will become apparent to those of ordinary skill in the art from the following written description and accompanying figures.

DESCRIPTION OF THE PREFERRED EMBODIMENT

Figure 1:
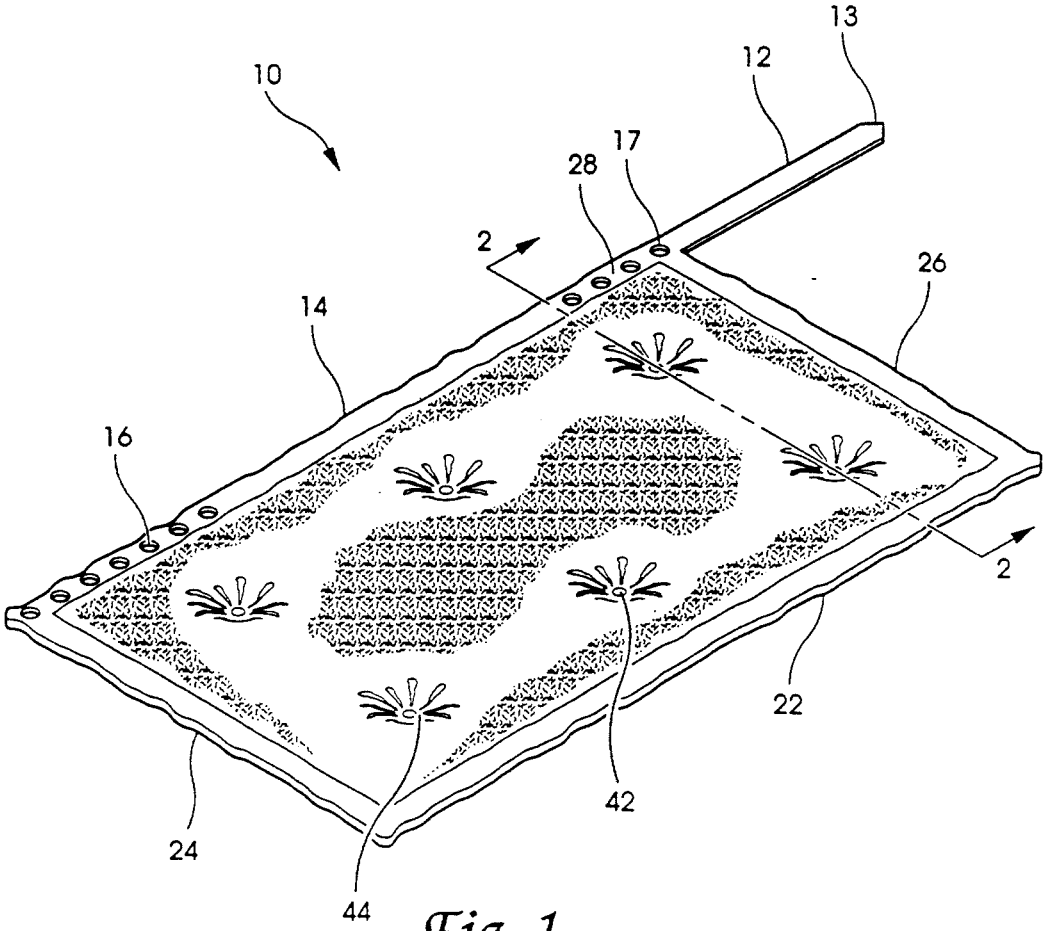
FIG. 1 is an elevational view of the disposable towel of one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, an elevational view of towel 10 is illustrated. Tie 12 is attached to top edge 14 and extends outward from side 26. A border 28 extends around the perimeter of the towel. The border 28 can be formed by applying a resin, which is preferably biodegradable, between the plies and then applying pressure to adhere the plies together. The resulting border 28 is a lamination of plies and resin that reinforces the side edges and apertures and which provides additional resistance to tearing. The border width may range from about one inch wide to about three inches wide, but is preferably about two inches. A preferred resin is an acrylic latex, polyvinyl alcohol, polyvinylpyrrolidone, a protein adhesive, a methylcellulose derivative or combinations thereof.

A plurality of apertures 16 are positioned at the border 28 along top edge 14 and extend inward from side edge 24 at one or two inch intervals from one another. The diameter of the apertures is preferably about one half the width of the border. The apertures 16 are at spaced intervals from tie 12 and allow the towel to be secured to persons of differing sizes. A plurality of apertures 17 are also positioned in the border 28 along top edge 14 adjacent to side edge 26. This arrangement allows the towel 10 to be wrapped around the person with side edges 24 and 26 overlapping to cover the person and with the tie extending through the apertures. Locating the apertures in the border 28 provides increased resistance to tearing due to the increased thickness of the border. Generally, the apertures are punched after the border is formed. It is preferred that at least one half inch of border surround each aperture to provide sufficient strength. The border 28 along the top edge 14 may be wider than along the other edges to provide further reinforcement to the apertures. The apertures may also include reinforcing rings to provide additional resistance to tearing.

The tie 12 may be a strand or string that is adhered to the top edge 14 by resin. Alternatively, the tie 12 may be a separate piece adhered to the sheet 10 along the full length of top edge 14, thereby reinforcing the border 28. In the preferred embodiment, the tie 12 is integrally formed as an extension of the border 28 along the top edge 14 beyond the side edge 26. An especially preferred tie is a two inch wide extension of the border which must be folded or curled as it is drawn through the apertures. This configuration in which the tie is wider than the aperture increases friction thereby further securing the tie within the aperture. It is preferred that the tie 12 extend from side edge 26 at least six to eight inches. Additionally, The tie end 13 may be tapered to facilitate placement of the end 13 through the apertures.

An especially preferred towel is 24 inches by 36 inches by one eighth inch thick and includes two inch borders around the edges, a two inch wide tie six inches long and seventeen one inch diameter apertures spaced at two inch intervals along the long side of the towel. About one inch is a preferred diameter the apertures. A preferred spacing for the apertures is about one to two inches apart.

Figure 2:
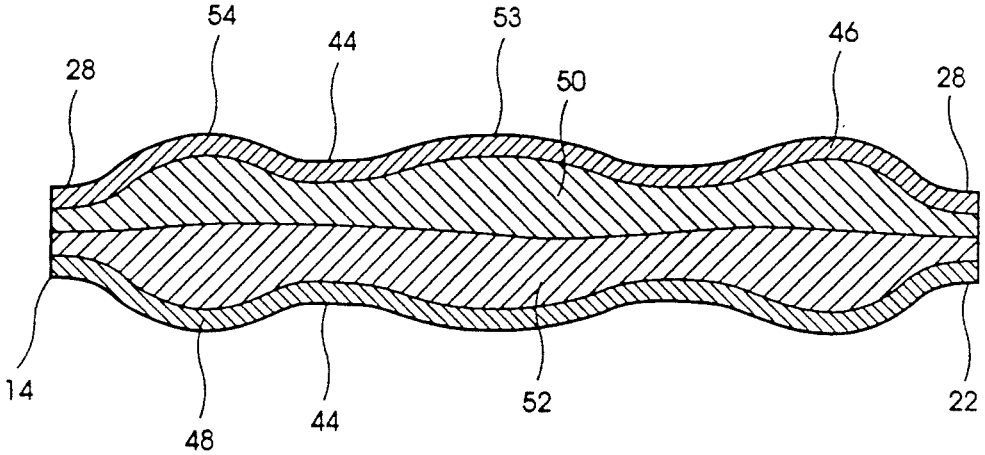
FIG. 2 is an cross-sectional view of the disposable towel taken along lines 2—2 on FIG. 1.

Referring to FIG. 2, a cross section of towel 10 is shown. Towel 10 comprises outer ply 46, outer ply 48, inner ply 50 and inner ply 52. The border 28 adjacent the top edge 14 and bottom edge 22 of the plies is shown having less thickness than the central portion 53 of the towel. Quilting points 42 also have a smaller cross-sectional thickness than the central portion 53. The sheet can be quilted by placing resin at quilting points 42 and then applying pressure to the plies. The resin applied between the plies to form the quilting points 42 also adheres the plies together in a resin ply laminate similar to the border 28. The quilting point 42 forms a quilting depression 44 having a cross sectional dimension which is less than the surrounding thickness of towel. The quilting increases the strength of the towel though additional bonding of the plies together and provides additional surface area for absorbing liquids. The quilting also provides a pleasing appearance which is similar to that of a soft quilted fabric and may form an attractive pattern. In areas where the resin is not supplied in sufficient amounts to bind the plies together, for example loft area 54, the towel fluffs out to a greater thickness which provides a cushioned softness and greater surface area.

The body towel is preferably comprised of a nonwoven fiberous sheet having a plurality of plies. It is preferred that the outer ply be formed from a soft paper material, such as tear resistant tissue or other soft paper material. The inner plies are not required to be as soft because they do not contact the skin, but they must be absorbent. The inner plies may be selected for resistance to tearing and for their absorbency. It is also preferred that the plies of the sheet have a basis weight from about 10 to about 60 grams per square meter. The thicknesses and number of the plies may be varied to provide differing amounts of absorptive capacity and flexibility characteristics of the towel. It is contemplated that the thickness of the towel ma be from 1/16 inch to 3/16 inch thick. A towel ⅛ inch thick is especially preferred.

An important characteristic of the towel is sufficient wet strength to enable the towel to dry a bather and to be secured about the bather without risk of tearing or loss of structural integrity when the towel is wet. It is contemplated that the towel be treated to improve its resistance to tearing when wet by applying a wet strength resin to the plies. The same type of resin which is applied to the border 28 and the quilting points 42 may also be applied to enhance the wet strength of the towel. Preferred wet strength resins include acrylic latex, polyvinyl alcohol, polyvinylpyrrolidone, protein adhesives, methylcellulose derivatives or combinations thereof.

It is also contemplated that resin be applied to the outer plies in a grid pattern to increase the tear resistance of the towel. Alternatively, reinforcing fibers may be incorporated into the plies for added strength. It is preferred that the resin be biodegradable to provide a biodegradable towel for environmental considerations.

The disposable bath towel may be imprinted with different colors and different patterns as decoration. An attractive scent may be applied to the bath towel. The bath towel may also be imprinted with logos for advertising promotions. It is also contemplated that the disposable towel be embossed with decorative designs to compliment the colored pattern for enhanced consumer appeal. The number and spacing of the quilting points may also be varied. The towel quilting may also be arranged in a distinctive pattern for product identity and aesthetic purposes.

Figure 3:
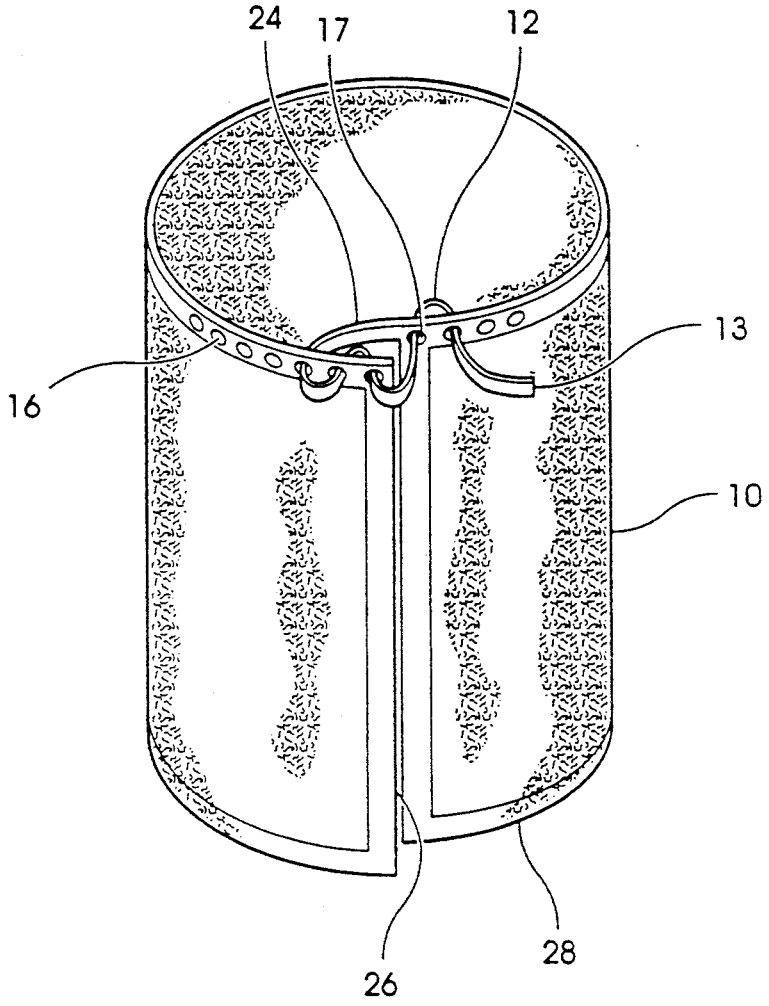
FIG. 3 shows the disposable towel with the tie passing through apertures for securing the disposable towel about a person's waist.

FIG. 3 illustrates the towel 10 shown in FIG. 1 wrapped around a person and secured thereto with the tie passing through the apertures. The user inserts the end 13 of tie 12 through an aperture 16 spaced from side edge 26 a distance corresponding approximately to the person's waist size. Then, the person inserts the tie 12 back through aperture 17 near side edge 26 to secure the tie end 13 and the towel about their body. The tie can pass through many apertures to minimize the risk that the towel will slip off the user. In the preferred embodiment, apertures 16 extend inward from side edge 24 and apertures 17 extend inward from side edge 26 along top edge 14. Alternatively, apertures can be spaced along the entire length of the border at the top 14 of the towel.

Figure 4:
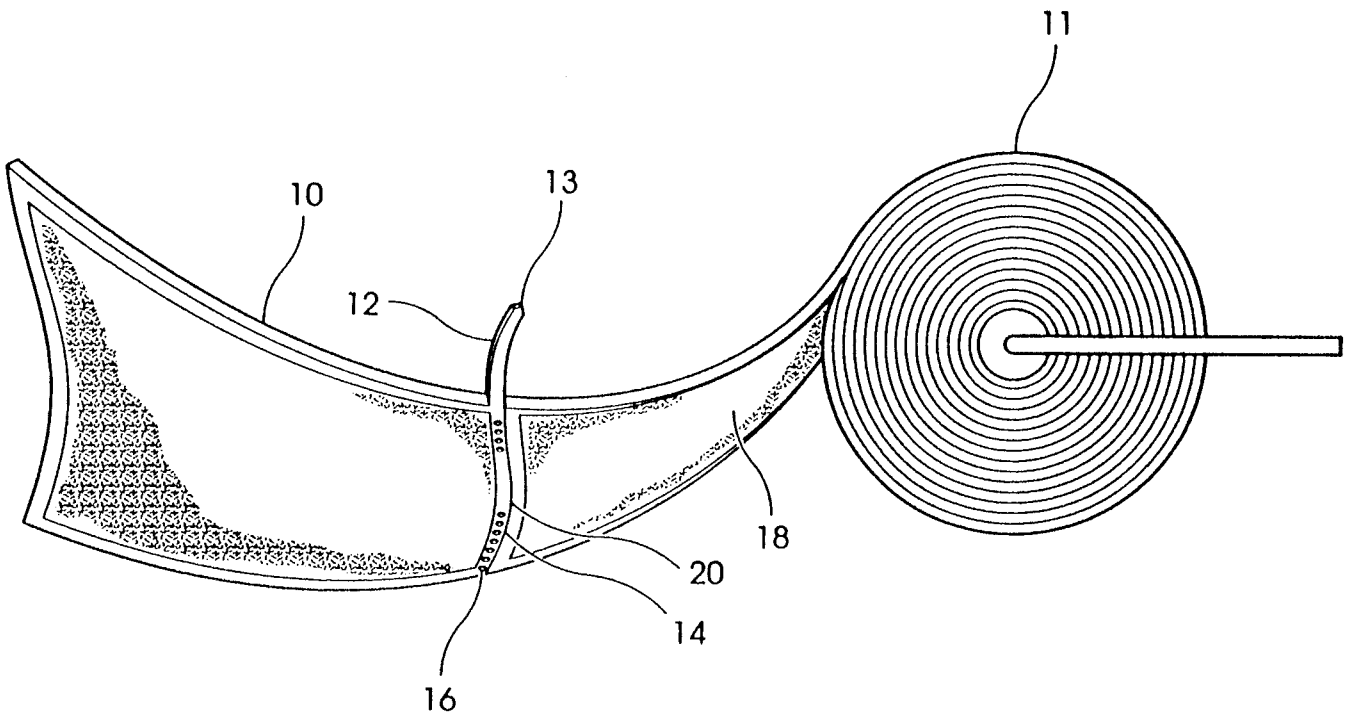
FIG. 4 shows a sheet of disposable towel extending from a roll of disposable towels in one means for dispensing the towels.

Referring to FIG. 4, one method of dispensing the disposable bath towel 10 is shown in which a perforated roll 11 of disposable bath towels is provided. Towel 10 includes a tie 12 attached to the top edge 14. Tie 12 includes a tie end 13 which extends from the towel 10.

The towel 10 also includes apertures 16 and 17 along the top edge through which the tie 12 may pass for securing the towel, as the towel is positioned to substantially cover the woman.

The towel 10 may be separated from adjacent towel 18 on the the roll 11 by applying a moderate twisting and pulling movement to towel 10 permitting the perforated section 20 between towel 10 and 18 to tear, thereby separating the adjacent towels. Perforated section 20 is positioned between the top edge 14 and bottom edge 22 of adjacent towels.

Figure 5:
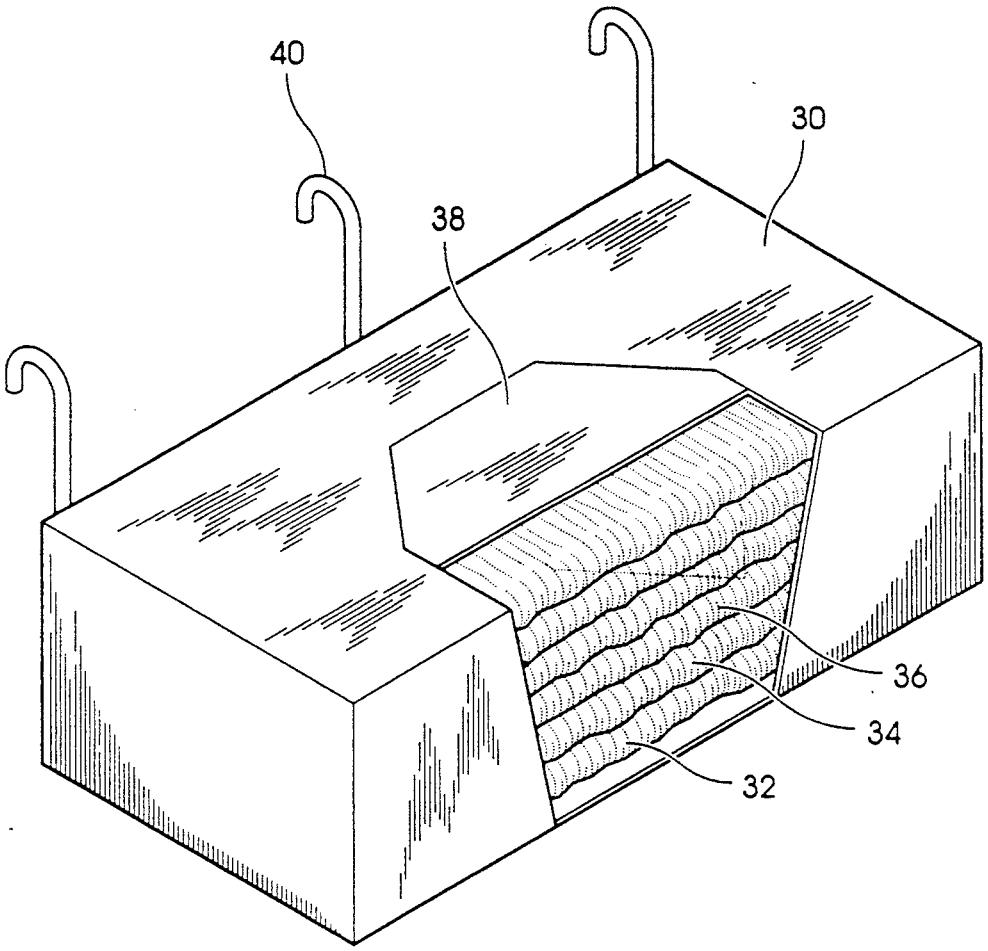
FIG. 5 is an illustration of stacked towels in a box in another means for dispensing the towels.

Referring to FIG. 5, an alternative towel dispenser 30 is shown which contains a stack 32 of precut folded disposable bath towels 34 is shown. It is preferred that the dispenser hold from about 12 to about 36 towels. Towel 34 is identical to towel 10 except that towel 34 is precut, folded and supplied in stacks rather than being provided on a roll with a perforated section separating adjacent towels. The stack 32 of folded towels 34 provides a convenient source of the disposable towels.

Towel dispenser 30 may be a cardboard box having a suitable opening for passage of the folded towels therethrough. Alternatively the dispenser 30 may be a reusable decorative dispenser formed from plastic or other suitable materials. Dispenser 30 includes a top flap 38 and may include one or more hooks 40 to allow the dispenser to fit over and be retained by a conventional cloth towel holder (not shown). It is also contemplated that the dispenser may include a decorative colorful pattern to compliment its surroundings.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A disposable body towel, comprising;

a flexible substantially planar sheet having a top edge, an opposite bottom edge, a first side edge and an opposite second side edge, said sheet including a number of water absorbent plies; and said sheet further including an elongated tie connected to said top edge and extending outward from said first side edge, and several apertures defined in said sheet along said top edge, wherein said apertures are adapted for passage of said tie therethrough for securing said towel around the body of a user, wherein a first plurality of said apertures are positioned adjacent said second side edge along said top edge, and a second number of said apertures is positioned adjacent said first side edge along said top edge.

2. The disposable towel of claim 1 wherein said sheet is supplied on a roll and is removably attached at one of its edges to an adjacent sheet.

3. The disposable towel of claim 1 wherein said sheet is folded and supplied in separate precut sheets.

4. The disposable towel of claim 1 wherein said plurality of plies are bonded by an acrylic latex resin.

5. The disposable towel of claim 1, wherein said first plurality of apertures are positioned about two (2) to six (6) inches from said second side edge at intervals of between about one (1) to two (2) inches.

6. The disposable towel of claim 1, wherein said second number of apertures includes a plurality of apertures extending from said first side edge toward said second side edge at about one (1) to two (2) inch intervals.

7. A disposable body towel, comprising;

a flexible substantially planar sheet having a top edge, an opposite bottom edge, a first side edge and an opposite second side edge and a border adjacent said edges, said sheet including a plurality of water absorbent plies, said plurality of plies being bonded together at said border, thereby reinforcing said edges to provide resistance to tearing of said sheet; and said sheet further including an elongated tie connected to said top edge and extending outward from said first side edge, and several apertures defined in said sheet along said top edge, wherein said apertures are adapted for passage of said tie therethrough for securing said towel around the body of a user, wherein said tie is integral with said border at said top edge.

8. The disposable towel of claim 4 wherein said resin is biodegradable.

9. The disposable towel of claim 1 wherein said plies are bonded together to form a quilted pattern on said sheet.

10. The disposable towel of claim 1 wherein each of said plies has a basis weight from about 10 to about 60 grams per square meter.

11. The disposable towel of claim 10 wherein each of said plies is treated with a wet strength resin.

12. A disposable body towel, comprising;

a flexible substantially planar sheet having a top edge, an opposite bottom edge, a first side edge and an opposite second side edge, said sheet including a number of water absorbent plies; and said sheet further including an elongated tie connected to said top edge and extending outward from said first side edge, and several apertures defined in said sheet along said top edge, wherein said apertures are adapted for passage of said tie therethrough for securing said towel around the body of a user, wherein said tie has a width greater than the diameter of said apertures.

* * * * *